United States Patent [19]

Ingram

[11] 4,282,818

[45] Aug. 11, 1981

[54] MOTION TRANSFER APPARATUS FOR TUFTING MACHINES

[75] Inventor: Gary L. Ingram, Ooltewah, Tenn.

[73] Assignee: Spencer Wright Industries, Inc., Chattanooga, Tenn.

[21] Appl. No.: 146,008

[22] Filed: May 8, 1980

[51] Int. Cl.[3] ..... D05C 15/00

[52] U.S. Cl. ..... 112/79 R

[58] Field of Search ..... 112/79 R, 79 A, 79 FF, 112/117, 220; 66/207

[56] References Cited

U.S. PATENT DOCUMENTS

| | | | |
|---|---|---|---|
| 3,026,830 | 3/1962 | Bryant et al. | 112/79 R |
| 3,934,524 | 1/1976 | Smith | 112/79 A |
| 3,964,408 | 6/1976 | Smith | 112/79 A |
| 3,972,295 | 8/1976 | Smith | 112/79 A |
| 4,173,192 | 11/1979 | Schmidt et al. | 112/79 R |

*Primary Examiner*—Ronald Feldbaum
*Attorney, Agent, or Firm*—Alan Ruderman

[57] ABSTRACT

A motion transfer apparatus interposed between a tufting machine needle bar and a needle bar positioner includes a first drive coupling member in the form of a wedge tooth connected to the positioner to follow its transverse step-wise movement, and a second drive coupling member in the form of a tooth receiving wedge socket mounted for movement toward and away from the tooth and for movement directed by the tooth when the members are coupled. The socket member is moved toward and away from coupling engagement cyclically by a follower whose movement is controlled by a cam driven in timed relationship with the tufting machine. The configuration of the cam moves the follower and thus the socket toward and into coupling engagement with the tooth during the small portion of the tufting machine cycle when the needles are above the base material, and to disengage and uncouple during the remaining major portion of the tufting machine cycle. The positioner device may therefor jog the first drive coupling member during the disengaged portion and this step motion is transmitted to the needle bar by the socket during the smaller portion of the cycle.

18 Claims, 6 Drawing Figures

MOTION TRANSFER APPARATUS FOR TUFTING MACHINES

BACKGROUND OF THE INVENTION

This invention relates to tufting machines and more particularly to apparatus for increasing the range of operation of a needle bar positioning device to jog the needles rapidly relatively to the base material.

In the production of tufted fabrics it is known to jog or shift the needle bar transversely across the tufting machine relatively to the base material in order to break up the unattractive alignment of the longitudinal rows of tufts known as the "corncob" effect and also to reduce the difficulty of visible optical streaking resulting from variations in coloration of the yarn, the latter difficulty being a result of variations in the dye absorbing property of heat set yarns. Various devices have been proposed and are in use for controllably applying a step-wise force to the needle bar of the tufting machine in accordance with a pattern. For example, the primary means for supplying this jogging has been a pattern cam driven in timed relationship to the reciprocation of the needle bar and acting upon a cam follower mechanism coupled to the needle bar. Exemplary of this prior art device are U.S. Pat. Nos. 3,026,830 and 3,934,524. Because of the limited patterning capabilities of a cam, and especially the limited longitudinal pattern repeat, the cam providing a longitudinal repeat every revolution of the cam, prior art needle bar shifters having patterning capabilities beyond that provided by the cam and follower systems have been developed. The known systems are disclosed in U.S. Pat. Nos. 3,964,408 and 3,972,295, which utilize pawl and ratchet devices, U.S. Pat. No. 4,010,700 which uses an indexing device, and U.S. Pat. No. 4,173,192 which uses a hydraulic actuator.

In these expanded prior art needle positioning devices the inherent inertia of the mechanical parts and of the hydraulic fluid, together with the inertia of the needle bar, is such that the system is substantially slower than that required by the tufting machine. Both the positioning apparatus and the needle bar are stepped laterally during the same portion of the tufting machine cycle. A substantial force from the positioner must be exerted during this part of the cycle to move the needle bar directly. Normally the needles are out of the base material fabric or the needle plate fingers for approximately 110° of the needle bar reciprocation cycle and the lateral or transverse shift must occur during this portion of the cycle in order to avoid damage to the needles. Thus, since only this small portion of the overall cycle is available for applying the force to move the needle bar laterally and since the positioners require a relatively large amount of time to perform the shift, the tufting machine is slowed excessively to increase the time the needles are free of the backing. In most cases tufting machines operating with a shifting needle bar mechanism run at approximately one third to one half the speed the tufting machine would be run without the shifter and the tufting machine therefore produces one third to one half of the pile fabric in the same period of time that it could.

SUMMARY OF THE INVENTION

The present invention overcomes these deficiencies of the prior art by providing motion transfer apparatus interposed between the needle bar of a tufting machine and a needle bar positioner that permits the positioner to step transversely during a relatively large portion of the needle bar reciprocation cycle but transmits this step to the needle bar during a relatively small portion of the cycle. Preferably, the positioner steps during one portion of the cycle, that being a large portion of the time the needles are within the base fabric, and the step is transferred to the needle bar during another portion of the cycle, this being the time the needles are out of the base fabric. The positioner acts against a low inertia part of the transfer apparatus and not directly on the relatively high inertia needle bar. A conventional needle bar positioner requiring a given period of time to perform its shift may thus transmit its step movement during the relatively large portion of the cycle and the needle bar receives this step shift during the relatively small time the needles are out of the base fabric. Thus, the apparatus acts to match the speed of the tufting machine to the positioner. It is envisioned that the needle bar can be shifted completely within approximately 90° and the preferred embodiment includes mechanism for receiving a step shift from the needle positioner within approximately 270° of the cycle and transmits this shift to the needle bar during part of this 90° portion.

Accordingly, it is a primary object of the present invention to provide motion transfer apparatus for use in conjunction with a tufting machine needle bar positioner that permits the positioner to step during a larger portion of the tufting machine cycle than the portion of the cycle during which the needle bar is shifted laterally.

It is another object of the present invention to provide motion transfer apparatus for use in conjunction with a tufting machine needle bar positioner that permits the positioner to step during a portion of the cycle that the needles are within the base material but transmits this step to the needle bar during the portion of the cycle in which the needles are out of the base fabric.

It is a further object of the present invention to provide motion transfer apparatus for use in conjunction with a tufting machine needle bar positioner that permits the positioner to step during one portion of the tufting machine cycle and transmits this shift to the needle bar during another portion of the cycle.

It is a still further object of the present invention to provide motion transfer apparatus for use in conjunction with a tufting machine needle bar positioner that permits the positioner to make a lateral jog during approximately 270° of the tufting machine cycle while transmitting this shift to the needle bar and completing the shift during the remaining approximately 90° of the cycle.

It is a yet further object of the present invention to provide motion transfer apparatus interposed between a tufting machine needle bar and a needle bar positioner that permits the positioner to act against a relatively low load and in a relatively large portion of the tufting machine cycle to make a shift and which itself acts against the needle bar load during a relatively small portion of the cycle.

It is yet a still further object of the present invention to provide a motion transfer apparatus for receiving a linear step motion at an input member during a first portion of a cycle and for transferring that motion at an output member during a shorter and different portion of the cycle.

One aspect of the apparatus of the present invention is the provision of a first drive coupling member driven by the needle bar positioner mechanism to follow its transverse step-wise movement, and a second drive coupling member disposed for cooperation with the first coupling member and moved toward and away from coupling engagement in synchronism with the cyclical movement of the needle bar, the second drive coupling member being interconnected with the tufting machine for changing the relative lateral position of the needle bar and base material.

More specifically, one of the drive coupling members, preferably the first drive coupling member, comprises a wedge shaped tooth, while the other drive coupling member comprises a complementary wedge shaped socket. The second drive coupling member is driven toward and away from coupling engagement with the first drive coupling member by cam means acting on follower means associated with the second drive coupling member and driven in timed relationship with the tufting machine drive, the cam means having a configuration to force the follower means and thus the second drive coupling member toward and into engagement with the first coupling member during the small portion of the tufting machine cycle when the needles are above the base material. The follower means and the second drive coupling member are permitted by the cam geometry to disengage and uncouple from the first coupling member during the remaining and major portion of the tufting machine cycle, and it is during this disengaged portion of the overall cycle that the first drive coupling member may be jogged by the needle bar positioning mechanism.

Another aspect of the present invention is the provision of a motion transfer apparatus for receiving a linear step motion at an input member of the apparatus during a first portion of a cycle and for transferring that motion by wedge shaped members cyclically driven into and out of motion coupling engagement, the motion being transferred at an output member during a shorter and different portion of the cycle.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 5:
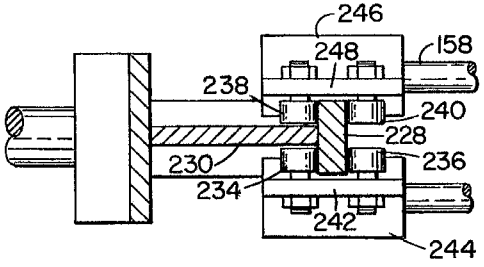
FIG. 5 is a horizontal cross sectional view of a portion of the apparatus taken substantially along line 5—5 of FIG. 2.
Figure 1:
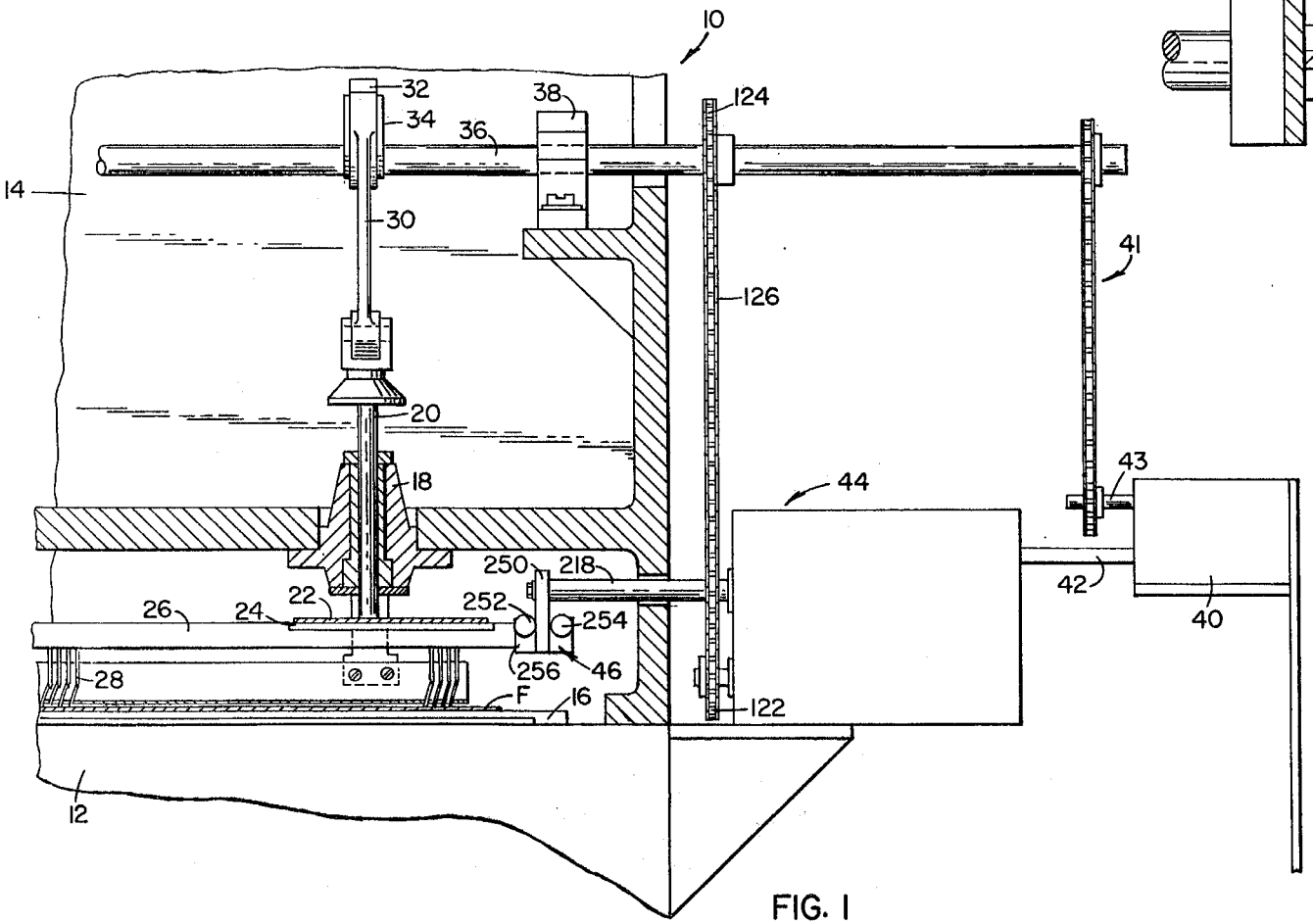
FIG. 1 is a fragmentary vertical cross sectional view through a tufting machine including a needle positioning mechanism and motion transfer apparatus constructed in accordance with the principles of the present invention.

Referring now to FIG. 1 a portion of a tufting machine 10 is illustrated having a frame comprising a bed 12 and a head 14 disposed above the bed. The bed 12 includes a needle plate 16 over which a backing fabric F is adapted to be fed in a conventional manner.

Mounted in the head 14 for vertical reciprocation within a bushing assembly 18 is one of a plurality of push rods 20 to the lower end of which a needle bar support foot 22 is carried. Support foot 22 has a substantially inverted U-shaped configuration in end elevation including uncut flanges 24 at the extremities to form a guide way. A needle bar 26 substantially conforming in shape to the interior of the support feet is positioned within the guide way on bearings for slideable movement relatively thereto. For a more detailed description of the construction of the needle bar reference is made to the aforesaid U.S. Pat. No. 3,026,830. The needle bar 26 may thus reciprocate with the push rods 20 and slide laterally relative thereto in the direction transverse to the feeding of the backing fabric.

The needle bar 26 carries a plurality of needles 28 that penetrate the fabric F on the needle plate 16 upon reciprocation of the needle bar 26 to project loops of yarn therethrough in a conventional manner. End wise reciprocation is imparted to the push rods 20 and thus the support feet 22 and the needle bar 26 and needles 28 by a link 32 that is pivotably connected at its lower end to each push rod and which has at its upper end an eccentric strap 32 journalled on an eccentric 34 secured to a driven rotary main shaft 36 journalled in bearing blocks 38 in the head 14. Although not illustrated a plurality of hooks or loopers adapted to cooperate individually with one of the needles to seize a loop of yarn presented thereby and to hold the same as the needle is withdrawn is conventionally mounted for oscilating motion beneath the needle plate in timed relationship with the rotation of the main shaft 36.

In order to shift or step the needle bar 26 with controlled lateral movement a needle positioner mechanism 40 is provided. The positioner may be a pattern cam such as illustrated in U.S. Pat. No. 3,026,830; a programmable mechanical device such as disclosed in U.S. Pat. Nos. 3,964,408 and 4,010,700; or a hydraulic device similar to that disclosed in U.S. Pat. No. 4,173,192. As will be understood the present invention allows the possibility of other devices for providing a step shift because of the relatively small force required to provide a shift. A stepper motor is one possibility. However, the specific needle bar positioning device used to provide the patterned step shift is not critical, as any of the known devices referred to above can be used in conjunction with the apparatus of the present invention. Each such device includes an output member 42 controlled in accordance with a pattern and driven in timed relationship to the tufting machine. As illustrated a chain and sprocket means 41 may drive an input member 43 from the tufting machine main shaft 36. Conventionally, the needle bar would be driven by the output member 42 of the positioning device which must provide its shift while the needles are out of the backing fabric F, or at least out of the needle plate 16. The present invention however, provides motion transfer apparatus generally designated at 44 interposed between the output member 42 of the positioning device and a coupling member 46 connected to the needle bar.

Figure 2:
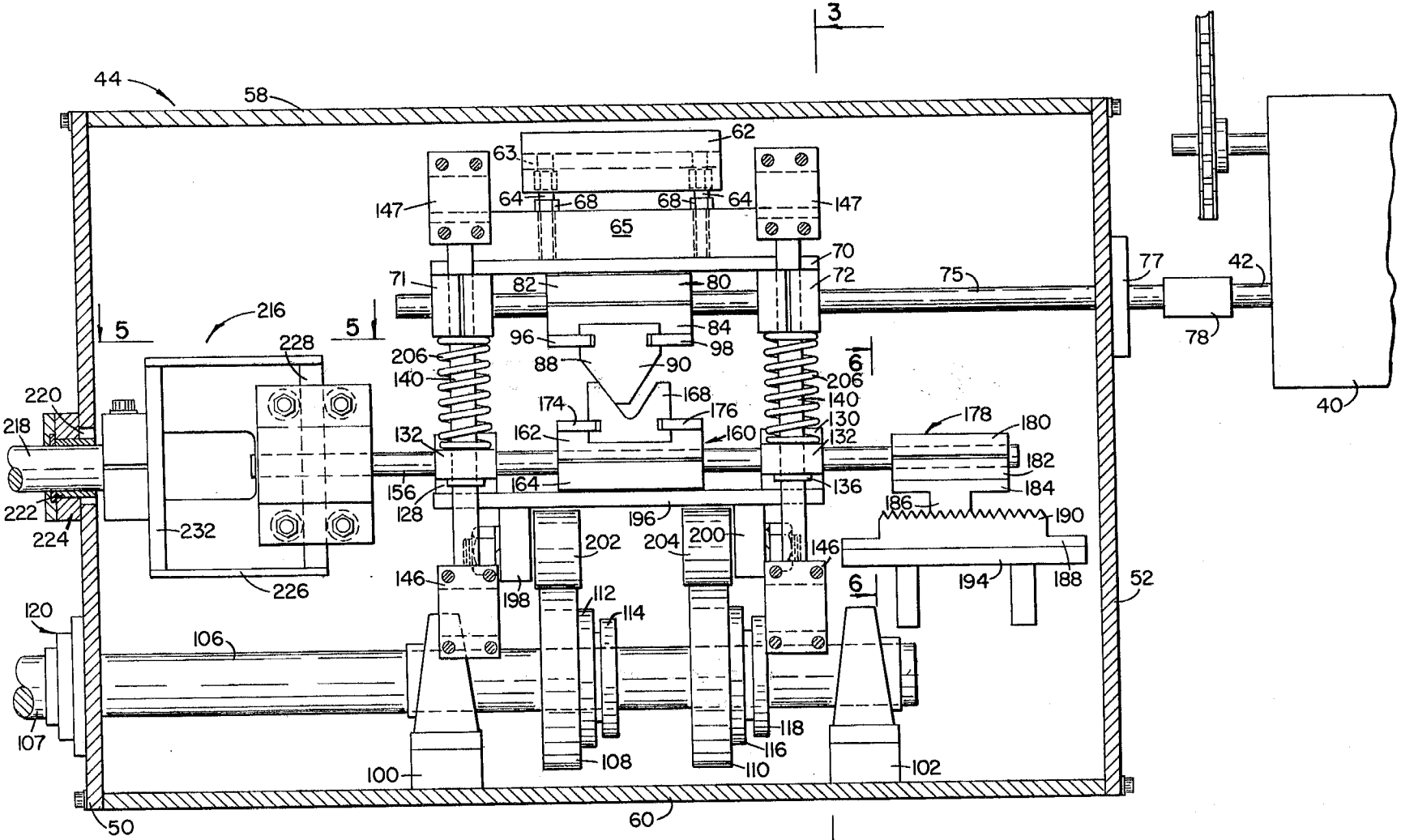
FIG. 2 is a longitudinal vertical cross sectional view through the motion transfer apparatus of the present invention.
Figure 3:
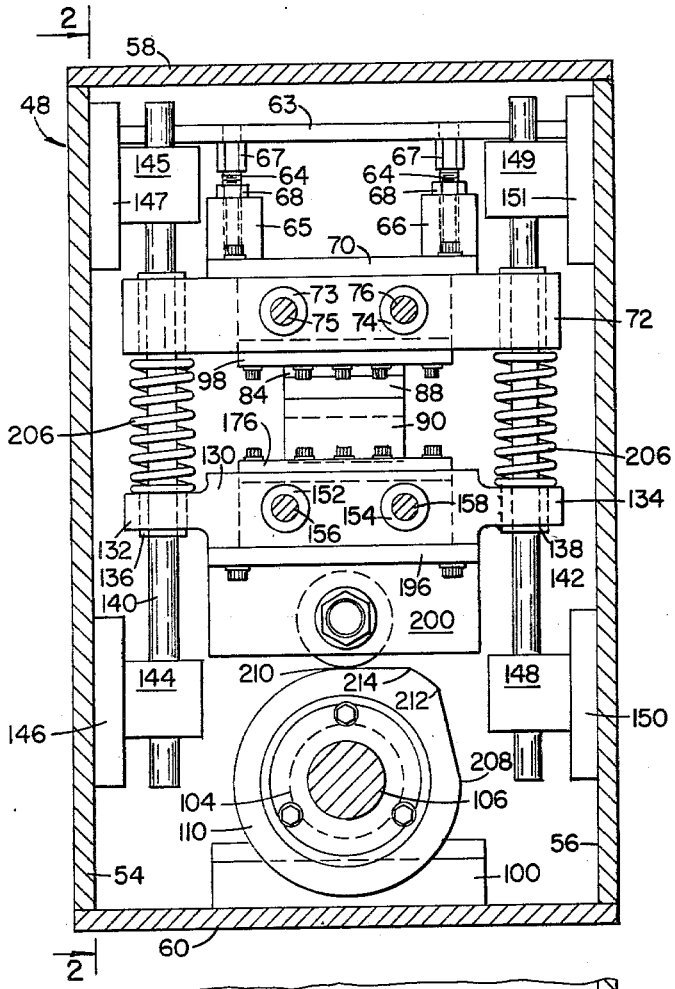
FIG. 3 is a vertical end cross sectional view taken substantially along line 3—3 of FIG. 2.
Figure 6:
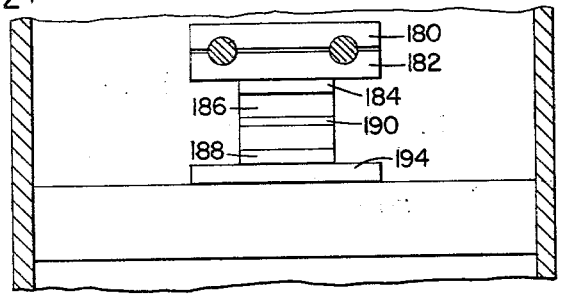
FIG. 6 is a vertical cross sectional view through the apparatus taken substantially along line 6—6 of FIG. 2 and illustrating the locking tooth construction.
Figure 4:
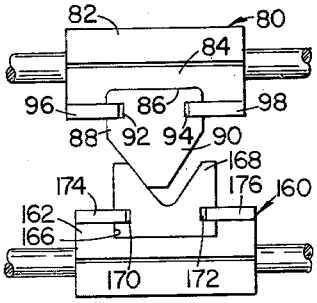
FIG. 4 is a view of a portion of the apparatus illustrated in FIG. 2.

The apparatus 44, as best illustrated in FIGS. 2 and 3, comprises a housing 48 of substantially rectangular configuration including a pair of end plate members 50 and 52 secured as by bolts to side frame members 54 and 56 and top and bottom frame members 58 and 60 respectively, the side frame members being welded or bolted to the top and bottom frame members to form a rigid structure. Secured to the inner wall of each side frame member 54,56 at oppositely disposed locations is a respective bracket 62, only one of which is illustrated. Each bracket 62 includes a horizontal flange for fixably supporting a plate 63 that spans the housing from side to side and includes four apertures for receiving the upper end of each of four respective threaded members 64 (only three of which are illustrated). A pair of longitudinally elongated substantially rectangular bars 65 and 66 are disposed beneath the plate 63, each including four vertically disposed threaded bores for receiving the lower end of a respective threaded member 64. Each of the threaded members includes an adjusting nut 67 fixed thereto and a rotatable threaded locking nut 68, the lock nuts abutting the respective bars 65 and 66 to position the bars vertically as will hereinafter become clear. Secured to and depending from the lower surfaces of both bars 65 and 66 is a support plate 70 to which a pair of spaced rod support blocks 71 and 72 are secured and depend downwardly. Each of the members 71,72 as best illustrated in FIG. 3 with reference to member 72, may be of a rectangular configuration elongated sidewise relatively to the housing 48, and includes a pair of bores for receiving a respective linear bearing 73 and 74, the corresponding bearings in the members 71 and 72 being in substantial alignment. Slideably supported within each pair of bearings 73 is a first input rod 75, while a second input rod 76 is positioned within each pair of bearings 74, both rods being slideable relatively to the housing.

Each of the input rods 75 and 76 projects out an opening of end plate 52, which may be sealed by collars 77 permitting sliding of the rods. A coupling member 78 has one end connected to both rods 72 and 74 and has its other end connected to the output member 42 of the positioner 40, the coupling being no more than a connector between the positioner 40 and the input to the apparatus 44. Secured to both rods 75,76 intermediate the support blocks 71,72 is a split carrier member 80 having an upper portion 82 and a lower portion 84 clamped securely thereto. The lower portion 84 includes a central recess 86 substantially parallel to the axes of the rods 75 and 76 and extending lengthwise of the member in the direction of the sides of the housing. Positioned in the recess is the upper part of a drive tooth body 88 having at the free end a downwardly depending tooth 90 having inclined faces and which may be truncated at the free end. The upper part of the tooth body 88 includes a pair of oppositely disposed grooves 92 and 94 extending the length of the tooth for receiving a respective lock plate 96 and 98 secured as by bolts to the lower portion 84 of the carrier member 80, thereby securing the tooth body 88 to the member 80.

Secured at space locations lengthwise on the bottom frame member 60 are a pair of bearing blocks 100 and 102 each carrying a rotary bearing member 104. Journally supported in each bearing 104 is a drive shaft 106 on which a pair of spaced cams 108 and 110 are fastened by means, for example, of a hub and collar 112,114 and 116,118, the hub being fixed to the cam and secured to the collar and locked onto the shaft 106 at one side of the cams 108, 110. One end 107, that being the left end as viewed in FIGS. 1 and 2, of the shaft 106 extends out the end plate 50 supported on bearings 120. Fastened on the end 107 of the shaft is a motion input member which as illustrated in FIG. 1 may be a sprocket 122. A similar sprocket 124 is fastened on the adjacent end of the tufting machine main shaft 36 and a timing drive chain 126 is trained about both sprockets to rotatably drive the shaft 106 in synchronism with the main shaft 36 and thus the needle bar 26.

Disposed beneath the input rods support blocks 71,72 and above the surfaces of cams 108 and 110 are respective output support blocks 128 and 130. Each of the blocks 128,130 comprises an elongated rectangular member having laterally extending wings 132,134 respectively on opposite sides thereof. Positioned within a respective journal member 136,138 in the respective wings 132,134 is a guide rod 140,142. The lower end of each guide rod 140 is secured to a respective horizontal inwardly facing flange 144 of a bracket 146 secured to the side frame wall 54 substantially intermediate the elevational extremities thereof. The guide rods 140 extend upwardly through bores in the support blocks 71 and 72 and are secured adjacent their upper ends in the flange 145 of a bracket 147 similar to bracket 146 and secured to the wall 54 above it. In a similar manner the guide rods 142 are secured at their lower ends in respective horizontal flange 148 of a bracket 150 secured to the wall 56, and at their upper ends in a flange 149 of a bracket 151 while extending freely through bores in the blocks 71 and 72. The blocks 128 and 130 thus can move vertically along the respective rods 140 and 142 but are fixed against movement in the horizontal plane. Each of the output support blocks 128,130 includes a pair of bores for receiving respective linear bearings 152 and 154 similar to the bearings 73 and 74 of the blocks 71 and 72. A respective output rod 156 and 158 is journally supported for sliding substantially parallel to the rods 74 and 75 within the bearings 152 and 154.

Secured to both output rods 156 and 158 is a split carrier member 160 having upper and lower portions 162 and 164 clamped together and to the rods. The member 160 is similar to the member 80 but the upper and lower portions are mounted on the rods 156, 158 in mirror image to the mounting of the member 80. Thus, the upper member 162 includes a central recess 166 similar to and extending parallel to the recess 86 of the member 84. Positioned in the recess 166 is the lower part of a tooth receiving socket 168 having an interior wall configuration adapted to complement the shape of the tooth 90 but having an apex in its valley which does not engage the truncated bottom of the tooth when they are fully engaged. The lower part of the exterior of the socket includes a pair of oppositely disposed grooves 170, 172 similar to that of the input carrier member 84 for receiving lock plates 174 and 176 secured to the member 162 to secure the socket thereto.

At the end of the rods 156, 158 adjacent the end plate 52 is a split block 178 having an upper portion 180 and a lower portion 182 secured thereto and clamped to the rods 156, 158. Secured to the lower block portion 182 is a lock tooth block 184 having at least one but preferably a number of lock teeth 186 depending downwardly therefrom. Disposed below the teeth 186 is a locking plate 188 having a plurality of keeper teeth 190 adapted to engage and mesh with the lock teeth 186. The locking plate is supported on bracket members 192 and 194 secured to the side frame members 48 and 56 respectively. For purposes which will be understood the spacing between adjacent lock teeth 186 and the valley between adjacent keeper teeth 190 is substantially equal to the gauge of the tufting machine, i.e., the spacing between adjacent needles 28 and adjacent hooks.

A lifting plate 196 spans and is secured to the underside of both the output support blocks 128 and 130 for vertical movement therewith, and the lower portion 164 of the carrier member 160 is rested on the lifting plate. Secured to the bottom of the lifting plate beneath the output support blocks 128, 130 is a respective follower carrier 198 and 200 which pivotably carries a respective roller follower 202, 204. The followers are disposed such that follower 202 engages the surface of cam 108 and follower 204 engages the surface of cam 110. With this construction, since the followers are constrained to move with the output support blocks 128 and 130 which slide vertically along the rods 140 and 142, gravitational force maintains contact of the followers against the respective cam. However, to insure a positive and rapid response one or more springs 206 may be coiled about the guide rods 140 and/or 142 to bias the followers downwardly.

Each cam 108, 110 has a peripheral cam surface such that for approximately 270° the followers and thus the tooth receiving socket 168 remain in the lowermost position with the lock tooth 186 engaged with the teeth 190 of the keeper tooth plate 188, and are in a raised disposition for the remaining approximately 90°. Thus, the cams, as illustrated in FIG. 3 with regard to cam 110, have a constant radius from point 208 going counterclockwise to point 210. The remaining portion of the cam surface clockwise from point 208 to point 210 is approximately 90° and has a radius increasing to a maximum at a point 212 substantially intermediate the points 208 and 210, i.e., approximately 45°. During the period of time the followers engage this 45° portion of the cams they are driven upwardly disengaging the teeth 184 from the teeth 190 and driving the socket 168 upwardly. As will be further explained hereinafter the socket 168 is constrained by the wedge action to move transversely in accordance with the tooth 90 and during this 45° period any step-wise motion that has been imparted to the tooth 90 by the positioner 40 is transmitted to the socket and thus the output rods 156 and 158. To insure sufficient time for the transverse movement to occur the cam surface may have a dwell from point 212 to a point 214, which as envisioned is approximately 15°. The remaining approximately 30° from point 214 to point 210 of the cam surface has a decreasing radius and allows the follower and the elements controlled thereby to drop down to the inactive position with the teeth 186 in mesh with the teeth 190 and the socket disengaged from the tooth 90 for the approximately 270° portion of the cycle, during which the needle bar positioner 40 may jog the input rods 75 and 76.

At the end of the rods 156,158 adjacent the end plate 50, the rods are connected through a coupling generally designated at 216 to one end of an output rod 218. The rod 218 extends out an opening 220 in the end plate 50 and is supported by a bearing 222 a collar 224, and is connected at its other end to the needle bar coupling 46. The coupling 216 comprises a box-like member 226 having an upstanding rear wall 228, another upstanding wall 230 extends across the member and substantially bisects the rear wall 228 and extends to a front upstanding wall 232. A pair of rollers 234,236 and 238,240 straddle the rear wall 228 at each side of the wall 230. Preferably identical pairs of rollers may be vertically disposed above or below these two pair to avoid any twisting tendencies. The rollers 234 and 236 are pivotably mounted on a plate 242 to which a clamping block 244 is attached, the rod 156 being secured to the block 244. Similarly, the rod 158 is secured to a clamping block 246 attached to a plate 248, and the rollers 238 and 240 are pivotably mounted on the plate. Consequently, as the rods 156 and 158 move vertically the rollers 234–240 roll vertically along the wall 228 yet when the rods 156 and 158 move transversely, the rollers force the wall 228 and thus the member 226 to follow. The transverse motion of the member 226 is transferred to the rod 218 which is clamped to the front wall 232 of the box-like member. The coupling 46 is similar in construction to the coupling 216 and includes a vertically extending plate 250 to which the rod 218 is bolted. A pair of rollers 252 and 254 straddle the plate at opposite sides thereof and are pivotably mounted on a mounting plate 256 secured to the end of the needle bar 26. Thus, the needle bar may reciprocate up and down as the plate 250 rides along the rollers 252 and 254 but when the rod 218 is moved transversely the plate transmits this movement to the rollers and thus to the needle bar. In operation, a controlled step shift is supplied by the positioner device 40 in timed sequence with the reciprocation of the needle bar 26 and this step shift is applied by the output member 42 to the rods 74 and 75 of the motion transfer apparatus 44, and this linear motion is manifested by a movement of the tooth 90. When the pattern control of the positioner 40 calls for a straight stitch by the needles no step is output to the output member 42 and thus the tooth 90 remains at the location directed during the previous stitch. The cams 108 and 110 are continuously rotated and engage the followers 202 and 204 respectively. Likewise the lift plate 196 is always biased into engagement with the rollers 202 and 204, and since they are secured to the output support blocks 128 and 130 which are constrained for movement along the rods 140 and 142, the blocks 128 and 130 move linearly toward and away from the input support blocks 71 and 72 as determined by the rotational position of the cams. The output rods 156 and 158 being journalled in the blocks 128 and 130 move vertically with the support blocks and carry the carrier member 160 and socket 168 therewith. Similarly, since the lock teeth 186 are carried by the output rods 156 and 158 their movement is also controlled by the rotational position of the cams.

During the portion of the cycle that the constant radius of the cam between the points 208 and 210 are in engagement with the respective followers the wedging tooth 90 is disengaged from the socket 168 and the locking teeth 186 are in locking engagement with the keeper teeth 190. It is during this 270° period of the needle bar reciprocation cycle that the positioner 40 may jog and effect transverse movement of the tooth 90. Since the needles are generally within the base material for approximately 250° of the needle bar cycle, the jogging by the positioner 40 therefore occurs during this normally unavailable portion of the cycle to drive the light weight input system including the tooth 90.

Shortly after the needles have ascended from the base material for its approximately 110° interval the point 208 on the periphery of the cams engages the followers and begins to drive them upwardly forcing the socket member into engagement with the tooth 90. As the wedge surface of the socket member 168 engages the complementary wedge surface of the tooth 90 the wedging action forces the surface of the socket to ride up the surface of the tooth angularly thereby imparting a transverse force and movement on the socket member thereby to drive the output rods 156 and 158 in the direction determined by the transverse displacement of the tooth 90 relatively to its prior disposition with the socket. Thus, if the tooth 90 has been driven to the left as viewed in the drawings the socket also is moved transversely to the left, the opposite movement occuring if the tooth 90 has been displaced to the right. If no jog has been applied by the positioner 40 the socket moves upwardly without any transverse movement. Any movement imparted to the socket is transferred by the output rods to the coupling member 216 and thence to the needle bar as previously explained.

As the cam continues to rotate to engage the point 212 with the followers the socket has been moved to its full extent, but to allow for inertia the radius of the cam is constant from point 212 to point 214 to allow all movement to have occured by the time point 214 has engaged the follower. From this point to the point 210 of the cams the follower is dropped due to the decreasing radius of the cam surface. As it does the socket disengages from the tooth 90 and the locking teeth 186 begin to descend into the valleys between the keeper teeth 190. At point 210 the locking teeth are fully engaged with the keeper to prevent any continuation of movement of the needle bar due to inertia. It should be noted that the spacing between adjacent teeth 186,190 is substantially equal to the gauge of the tufting machine, i.e., the spacing between adjacent needles. Thus, if due to wear between the tooth 90 and the socket 168 an exact gauge shift does not occur this is corrected by the locking tooth system. When the gauge of the tufting machine is changed there is thus no need to change the cam tooth 90 and the socket 168, but the keeper plate 188 and the lock tooth block 184 must be changed. Since all movement to the needle bar is imparted during the period that the followers are in engagement with the cam surfaces between points 208 and 214, a period of approximately 60°, all movement to the needle bar is imparted during a small portion of the cycle. Thus, a needle positioner requiring a given amount of time in order to perform its jog can transfer its movement through the motion transfer device 40 and have this movement imparted to the needle bar in a relatively short period. Consequently the tufting machine may continue to run at the capable speeds without necessity of being slowed down to the requirements of the positioner.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. Apparatus in combination with a tufting machine having a reciprocating needle bar carrying a plurality of needles spaced transversely across the machine and adapted to penetrate a base material moving longitudinally thereof to insert a plurality of stitches upon each penetration of the base material, said machine including mounting means for permitting relative transverse movement between the needle bar and the base material, and a positioning device providing a controlled transverse step shift at an output drive member during a first portion of the needle bar reciprocation cycle, said apparatus comprising, a first drive coupling member, means connecting said member to said positioning device output drive member for transverse movement therewith, a second drive coupling member disposed for engagement with said first drive coupling member, said first and second drive coupling members having complementary engageable surfaces, the surface of said first drive coupling member constraining and directing the movement of said second drive coupling member when said members engage, actuating means driven in timed relationship with the reciprocation of said needle bar for moving the second drive coupling member into engagement with the first drive coupling member during a second portion of said cycle and for moving and maintaining said second drive coupling member out of engagement therewith during the remainder of said cycle, said second portion of said cycle being different than said first portion, and connecting means connecting said second drive coupling member to said mounting means for shifting the needle positions transversely relatively to said base material.

2. Apparatus as recited in claim 1 wherein one of said first and second drive coupling members comprises a tooth member having inclined faces forming one of said first and second surfaces respectively and said other drive coupling member comprises a socket member having complementary inclined faces forming the other surface.

3. Apparatus as recited in claim 1 wherein said actuating means includes means for mounting said second drive coupling member for movement toward and away from the path of movement of said first drive coupling member.

4. Apparatus as recited in claim 1 wherein said actuating means includes cam means journalled for rotation in timed relationship with the reciprocation of said needle bar, follower means driven by said cam means, means for mounting said follower means for constraining the follower means to move in a path toward and away from the path of movement of said first drive coupling member, and means acted upon by said follower means for moving said second drive coupling member toward and away from the path of movement of said first drive coupling member.

5. Apparatus as recited in claim 1 including locking means for locking said second drive coupling member against transverse movement except during said second portion of said cycle.

6. Apparatus as recited in claim 3 wherein said connecting means includes an output rod, and coupling means intermediate said second drive coupling member and said rod for permitting transverse movement of said output rod with said second drive coupling member and for precluding movement of said output rod in a direction toward and away from the transverse movement.

7. Apparatus as recited in claim 2 wherein said actuating means includes cam means journalled for rotation in timed relationship with the reciprocation of said needle bar, follower means driven by said cam means, means for mounting said follower means for constraining the follower means to move in a path toward and away from the path of movement of said first drive coupling member, and means acted upon by said follower means for moving said second drive coupling member toward and away from the path of movement of said first drive coupling member.

8. Apparatus as recited in claim 7 wherein including locking means for locking said second drive coupling member against transverse movement except during said second portion of said cycle.

9. Apparatus as recited in claim 1 wherein said first and second drive coupling members comprise wedges, one of said wedges being a male member, and the other of said members being a female member.

10. Apparatus as recited in claim 9 wherein said means for connecting said first drive coupling member to said positioning device includes an input drive rod journalled for transverse sliding, means for securing said first drive coupling wedge to said input drive rod, said second drive coupling member comprising support block means journally mounted for linear movement toward and away from said input drive rod, an output drive rod journally carried by said support block means for linear movement relatively thereto, and means for securing said second drive coupling wedge to said output drive rod.

11. Apparatus as recited in claim 10 wherein said actuating means comprises cam means journalled for rotation in timed relationship with the reciprocation of said needle bar, follower means driven by said cam means, and means for mounting said follower means on said support block.

12. Apparatus as recited in claim 11 including locking means for locking said second drive coupling member against transverse movement except during said second portion of said cycle.

13. Apparatus as recited in claim 12 wherein said locking means comprises at least one locking tooth, means for securing said locking tooth to said output drive rod, a keeper member having a plurality of spaced teeth, and means for mounting said keeper for cooperative engagement of said locking tooth between adjacent keeper teeth during said second portion of said cycle, said keeper teeth being spaced apart a distance substantially equal to the spacing between said needles.

14. Apparatus as recited in claim 13 wherein said connecting means includes an output rod, and coupling means intermediate said second drive coupling member and said rod for permitting transverse movement of said output rod with said second drive coupling member and for precluding movement of said output rod in a direction toward and away from the transverse movement.

15. Apparatus as recited in claims 4 or 11 wherein said cam means comprises a peripherial cam surface having a first section increasing in radius from a minimum to a maximum, a second section adjacent said section having a radius decreasing from said maximum to said minimum and a third section adjacent said first and second sections having a substantially constant radius at said minimum, said follower means engaging said first section during said second portion of said cycle and engaging said third section during said first portion of said cycle.

16. A motion transfer apparatus for receiving a linear step motion at an input member during a first period of time and for transferring that motion at an output member during a second and smaller period of time, said first and second periods being different times in a machine cycle, said apparatus comprising, a first wedge shaped drive coupling member, a second wedge shaped drive coupling member complementary to said first wedge shaped drive coupling member and disposed for engagement therewith, means for connecting one of said first and second wedge shaped drive coupling member to said input member for linear movement therewith, means for mounting the other wedge shaped drive coupling member for movement toward and away from said one member and for movement directed by said one member when said wedge shaped members are engaged, and actuating means driven in timed relationship with said machine cycle for moving said other wedge shaped drive coupling member into engagement with said one wedge shaped drive coupling member during said second period of time and for moving said other wedge shaped drive coupling member out of engagement with said one wedge shaped drive coupling member and for maintaining them disengaged during said first period of time, and means for connecting said other wedge shaped drive coupling member to said output member.

17. Apparatus as recited in claim 16 wherein said means connecting said one member to said input member includes an input drive rod journalled for transverse sliding, means for securing said one member to said input drive rod, said means for mounting said other wedge shape drive coupling member comprises support block means journally mounted for linear movement toward and away from said one wedge shaped drive coupling member, an output drive rod journally carried by said support block means for linear movement relatively thereto, and means for securing said other wedge shaped drive coupling member to said output drive rod.

18. Apparatus as recited in claim 17 wherein said actuating means includes a cam means journalled for rotation in timed relationship with said machine cycle, follower means driven by said cam means, and means for mounting said follower means on said support block.

* * * * *